US005266237A

United States Patent [19]

Freeman et al.

[11] Patent Number: 5,266,237

[45] Date of Patent: Nov. 30, 1993

[54] ENHANCING DETERGENT PERFORMANCE WITH POLYSUCCINIMIDE

[75] Inventors: Michael B. Freeman, Harleysville, Pa.; Yi H. Paik, Princeton, N.J.; Ethan S. Simon, Ambler; Graham Swift, Blue Bell, both of Pa.

[73] Assignee: Rohm and Haas Company, Philadelphia, Pa.

[21] Appl. No.: 924,697

[22] Filed: Jul. 31, 1992

[51] Int. Cl.[5] ..... C11D 3/28; C11D 3/37

[52] U.S. Cl. ..... 252/542; 252/174.23; 252/524; 252/DIG. 2

[58] Field of Search ..... 252/175, 180, 174.23, 252/174.24, DIG. 2, DIG. 11, 542, 524, 544, 546; 548/545, 546, 547; 528/328; 525/419, 420

[56] References Cited

U.S. PATENT DOCUMENTS

| | | | |
|---|---|---|---|
| 2,754,291 | 7/1956 | Pollack | 252/175 |
| 3,251,778 | 5/1966 | Dickson et al. | 252/180 |
| 3,474,083 | 10/1969 | Shiga et al. | 252/8.8 |
| 3,623,985 | 11/1971 | Hendrickson | 252/51.5 A |
| 3,723,460 | 3/1973 | Brannen et al. | 548/545 |
| 3,764,559 | 10/1973 | Mizuno et al. | 252/99 |
| 3,846,380 | 11/1974 | Fujimoto et al. | 252/356 |
| 4,102,799 | 7/1978 | Finck | 252/99 |
| 4,153,564 | 5/1979 | Chibnik | 252/51.5 A |
| 4,182,684 | 1/1980 | Lannert | 252/99 |
| 4,203,858 | 5/1980 | Chakrabarti | 252/135 |
| 4,259,189 | 3/1981 | Li | 252/357 |
| 4,325,829 | 4/1982 | Duggleby et al. | 252/109 |
| 4,379,080 | 4/1983 | Murphy | 252/526 |
| 4,440,625 | 4/1984 | Go et al. | 252/47.5 |
| 4,534,881 | 8/1985 | Sikes et al. | 252/175 |
| 4,590,260 | 5/1986 | Harada et al. | 528/328 |
| 4,608,188 | 8/1986 | Parker et al. | 252/99 |
| 4,686,062 | 8/1987 | Kermode et al. | 252/99 |
| 4,882,080 | 11/1989 | Donovan | 252/117 |
| 4,911,856 | 3/1990 | Lokkesmoe et al. | 252/175 |
| 4,929,425 | 5/1990 | Hoots et al. | 252/180 |
| 5,057,597 | 10/1991 | Koskan | 528/328 |
| 5,093,040 | 3/1992 | Donovan | 252/542 |
| 5,112,507 | 5/1992 | Harrison | 252/51.5 A |
| 5,116,513 | 5/1992 | Koskan et al. | 252/180 |
| 5,152,902 | 10/1992 | Koskan et al. | 252/180 |
| 5,219,986 | 6/1993 | Cassata | 530/324 |

FOREIGN PATENT DOCUMENTS

| | | |
|---|---|---|
| 454126 | 10/1991 | European Pat. Off. . |
| 0511037 | 10/1992 | European Pat. Off. . |
| 2230021 | 10/1990 | United Kingdom . |

OTHER PUBLICATIONS

E. Kokufuta et al., "Temperature Effect on the Molecular Weight and the Optical Purity of Anhydropolyaspartic Acid," Bul. Chem. Soc. Japan, 61(5):1555-1556 (1978).

*Primary Examiner*—Paul Lieberman
*Assistant Examiner*—A. Hertzog
*Attorney, Agent, or Firm*—David T. Banchik

[57] ABSTRACT

Detergent compositions containing from 0.5 to about 50 percent by weight polysuccinimide are provided. These compositions have enhanced anti-encrustation, soil removal and anti-redeposition properties.

10 Claims, No Drawings

ENHANCING DETERGENT PERFORMANCE WITH POLYSUCCINIMIDE

FIELD OF THE INVENTION

This invention relates to methods of enhancing the performance of detergent compositions. More specifically, this invention relates to methods of enhancing the anti-encrustation, soil removal and anti-redeposition properties of detergent compositions by adding thereto an effective amount of polysuccinimide.

BACKGROUND OF THE INVENTION

During the past three decades, efforts have been made in the detergent industry to convert from the eutrophying polyphosphates to more environmentally acceptable materials such as polycarboxylic acid polymers (e.g., polyacrylic acids).

Polycarboxylic acid polymers have been known to impart favorable performance and processing properties when incorporated into detergent formulations. Polymers may act as builders or as builder-assists in these formulations. They prevent incrustation of hardness ions onto the fabric, and surfaces, and improve soil or stain removal and anti-redeposition properties of the detergents.

Because large volumes of chemicals are used in detergent applications, and because these chemicals may eventually enter the environment and reside in subsurface waters or open bodies of surface waters, it is highly desirable for such chemicals to be degradable.

While the polycarboxylic acid polymers and copolymers currently used in detergents and water treatment applications do not suffer from the drawbacks of the phosphorus-containing inorganic builders or the foam-producing ABS surfactants, the past has taught it is most desirable that chemicals used in large volume applications which enter the environment be biodegradable. Unfortunately, most polycarboxylic acid polymers and copolymers useful in detergent applications or as dispersants or as water treatment chemicals are not highly biodegradable.

One class of poly(carboxylic acids) believed to be biodegradable are poly(amino acids). For example, European Patent Application 454,126 A1 discloses poly(amino acids) such as poly(aspartic acid) and poly(glutamic acid) as biodegradable builders and cobuilders in detergent formulations. Poly(aspartic acid) is also disclosed as a detergent builder in U.S. Pat. No. 4,325,829 to Duggleby et al.

Poly(aspartic acid) can be formed by hydrolysis of anhydropolyaspartic acid, a.k.a. polysuccinimide. Several methods are known for obtaining polysuccinimide. Polysuccinimide can be prepared by thermal polycondensation of aspartic acid as disclosed in E. Kokufuta et al., "Temperature Effect on the Molecular Weight and the Optical Purity of Anhydropolyaspartic Acid," *Bul. Chem. Soc. Japan,* 61(5):1555-1556 (1978). Also, U.S. Pat. No. 5,057,597 to Koskan discloses a solid-phase process for preparing polysuccinimide by fluidizing aspartic acid with agitation in a nitrogen atmosphere at a temperature of at least 180° C. for three to six hours. The resultant polysuccinimide is then hydrolyzed to form a poly(amino acid).

The hydrolysis of polysuccinimide imparts additional expense by virtue of additional raw materials and processing time. Furthermore, the hydrolysis may result in a poly(aspartic acid) solution which imparts difficulties when attempting to formulate a powdered detergent.

SUMMARY OF THE INVENTION

It is an object of the present invention to provide detergent formulations with enhanced performance by incorporating into the formulations an effective amount of polysuccinimide.

It is a further object of the present invention to provide detergents with enhanced anti-encrustation, soil removal and anti-redeposition properties.

It is a further object of the present invention to provide a detergent additive which can be formulated as a solid.

BRIEF DESCRIPTION OF THE INVENTION

The present invention provides detergent compositions formulated with polysuccinimide. Formulating detergents with polysuccinimide enhances soil removal and anti-redeposition properties of the detergent. Polysuccinimide, which is a granular solid, is easily formulated into granular or powdered detergent compositions.

DETAILED DESCRIPTION OF THE INVENTION

Suitable polysuccinimides have weight average molecular weights ($M_w$) of from about 1,000 to about 30,000, preferably from about 1,500 to about 10,000 and most preferably from about 2,000 to about 7,000 as measured by aqueous gel permeation chromatography (GPC), and can be prepared by techniques well known to those skilled in the art.

The polysuccinimide may be incorporated into the detergent formulation at levels where they provide the intended benefit. Generally this level will be from 0.5 to about 50 percent, preferably from about 1 to about 30 percent by weight of polysuccinimide solids based on the total detergent formulation.

The detergent formulations to which the polysuccinimide may be added are any of those typically available. Detergent formulations include laundry detergent formulations and automatic machine dishwashing detergent formulations. These formulations generally contain builders, and may also contain surfactants, buffering agents, bleaches, enzymes, stabilizers, perfumes, whiteners, softeners, preservatives, and water.

Examples of builders which may be used along with polysuccinimide in detergent formulations include zeolites, sodium carbonate, low molecular weight polycarboxylic acids, nitrilotriacetic acid, citric acid, tartaric acid, the salts of the aforesaid acids and the monomeric, oligomeric or polymeric phosphonates such as orthophosphates, pyrophosphates and especially sodium tripolyphosphate. Preferably, the detergent formulations are substantially free of phosphates. Builders may be present in the detergent formulations at levels of from about 0.5 to about 85 percent by weight and preferably from about 5 to about 60 percent by weight of the formulation.

Detergent formulations of the present invention may be in any of the several physical forms, such as powders, beads, flakes, bars, tablets, noodles, pastes, and the like. Preferably, the detergent formulation is a powder. The detergent formulations are prepared and utilized in the conventional manner and are usually based on surfactants and, optionally, on either precipitant or sequestrant builders. Typical detergent formulations are found, for example, in U.S. Pat. Nos. 4,379,080, 4,686,062, 4,203,858, 4,608,188, 3,764,559, 4,102,799, and 4,182,684 incorporated herein by reference.

Suitable surfactant are, for example, anionic surfactants, such as from $C_8$ to $C_{12}$ alkylbenzenesulfonates, from $C_{12}$ to $C_{16}$ alkane sulfonates, from $C_{12}$ to $C_{16}$ alkylsulfates, from $C_{12}$ to $C_{16}$ alkylsulfosuccinates and from $C_{12}$ to $C_{16}$ sulfated ethoxylated alkanols and nonionic surfactants such as from $C_6$ to $C_{12}$ alkylphenol ethoxylates, from $C_{12}$ to $C_{20}$ alkanol alkoxylates, and block copolymers of ethylene oxide and propylene oxide. Optionally, the end groups of polyalkylene oxides can be blocked, whereby the free OH groups of the polyalkylene oxides can be etherified, esterified, acetalized and/or aminated. Another modification consists of reacting the free OH groups of the polyalkylene oxides with isocyanates. The nonionic surfactants also include $C_4$ to $C_{18}$ alkyl glucosides as well as the alkoxylated products obtainable theretrom by alkoxylation, particularly those obtainable by reaction of alkyl glucosides with ethylene oxide. The surfactants usable in detergents can also have an amphoteric character. The surfactants can also can be soaps.

In general, the surfactants constitute from 0 to about 50, preferably from about 5 to about 45 percent by weight of the detergent or cleaning formulation. Liquid detergents usually contain as components liquid or even solid surfactants which are soluble or at least dispersible in the detergent formulation. Surfactants suitable for this purpose are liquid polyalkylene oxides or polyalkoxylated compounds, products that can also be used in powdered detergents.

The amounts of the individual substances used in the preparation of detergent formulations by weight based on the total weight of the detergent formulation are, for example, up to about 85 percent sodium carbonate, up to about 50 percent zeolites, and up to about 50 percent surfactants.

Other common additives to detergent formulations are bleaching agents, used in an amount of up to 30 percent by weight, corrosion inhibitors, such as silicates, used in an amount of up to 25 percent by weight and graying inhibitors used in an amount of up to 5 percent by weight. The detergent formulations may also contain up to about 5 percent by weight of adjuvants such as perfumes, colorants and bacterial agents. Suitable bleaching agents are for example, perborates, percarbonates or chlorine-generating substances, such as chloroisocyanurates, suitable silicates used as corrosion inhibitors are, for example, sodium silicate, sodium disilicate and sodium metasilicate and examples of graying inhibitors are carboxymethylcellulose, methylcellulose, hydroxypropylmethylcellulose and graft copolymers of vinyl acetate and polyalkylene oxides having a molecular weight of 1000 to 15,000. Other common detergent additives optionally used are optical brighteners, enzymes and perfumes. The detergent formulations can also contain up to 50 percent by weight of an inert diluent, such as sodium sulfate, sodium chloride, or sodium borate. The detergent formulations can be anhydrous or they can contain small amounts, for example up to 10 percent by weight, of water which may be added separately or may be introduced into the formulation as a minor component of one or more of the other components of the detergent formulation.

If desired, the polysuccinimide can be used in detergent formulations together with other polymeric additive such as polymers of acrylic acid and maleic acid or acrylic acid homopolymers, or poly(amino acids) such as polyaspartic acid. These other polymeric additives are currently being used as soil redeposition inhibitors in detergent formulations. In addition, copolymers of from $C_3$ to $C_6$ monocarboxylic and dicarboxylic acid or maleic anhydride and from $C_1$ to $C_4$ alkyl vinyl ethers are also suitable as soil redeposition inhibitors. The molecular weight of these homopolymers and copolymers is 1000 to 100,000. If desired, these soil redeposition inhibitors can be used in detergents, together with the polysuccinimide, in an amount of up to 20 percent by weight based on the total formulation.

Polysuccinimide Sample Preparation 506 grams of L-aspartic acid was spread evenly in a 33×22×5 centimeter rectangular glass tray and placed in a muffle furnace at 240° C. for seven hours. Approximately once per hour, the tray was removed, the contents were stirred with a spatula and the tray was replaced in the muffle furnace. 365 grams of a tan-colored powder, was formed. The identity of this powder was confirmed by $^1H$ NMR spectroscopy as being polysuccinimide.

Poly(Aspartic Acid) Sample Preparation 750 milliliters of 2N aqueous sodium hydroxide was added dropwise to 175 grams of polysuccinimide (prepared above) such that the pH did not go above 10 while maintaining the mixture at 50°-60° C. After the addition of the sodium hydroxide was complete, the mixture was maintained at 50°-60° C. for one hour. After one hour, the pH was adjusted to 9 by the dropwise addition of 13 milliliters of 1N aqueous hydrogen chloride. The aspartic acid was lyophilized to yield 201 grams of aspartic acid as confirmed by $^1H$ NMR spectroscopy. The $M_w$, as measured by aqueous GPC, was 4,370.

The polysuccinimide and poly(aspartic acid) prepared above were used in the following performance evaluations.

Soil Removal and Anti-Redeposition Performance Evaluation

The efficacy of polysuccinimide for clay soil removal and anti-redeposition was evaluated by washing soiled cotton and cotton/terry blended fabrics in the detergent formulation shown in Table I.

Cotton cloth #405 was purchased from Test Fabrics, Inc. (Middlesex, N.J.) and cut to a specified size (3½"×4½"). The cloths were then soiled by applying from 0.9 to 1.1 grams of a 50% clay slurry (in water) using a China bristle brush (#10). The soil was "painted" onto the cloth inside a 2" diameter circle and allowed to air dry overnight prior to laundering. The clay used to soil the cloths was a reddish-brown particulate clay.

The detergent compositions were tested in a Terg-o-Tometer at the following conditions; 40° C., 100 rpm, 100 ppm hardness (50% city tap water/50% de-ionized water), 12 minute wash with one 3 minute rinse, 1300 ppm detergent and 5 cloths per pot (3 of them soiled). The wash water was pre-heated, the fabric swatches were added and then dissolved detergent (2.6 grams of a 50% slurry in 100 milliliters water) was added. Following the wash period the swatches were wrung, and following the rinse cycle the swatches were wrung again and then air dried. Swatches washed in a detergent containing no polymer were always run as a control.

Reflectance was measured using a Pacific Scientific Colorimeter (Colorgard System 1000) and the data recorded using the L,a,b color scale. Detergency values (E), a measure of soil removal, and whiteness index (W.I.), a measure of anti-redeposition, are calculated as:

$$E=(L_s-L)^2+(a_s-a)^2+(b_s-b)^2)^{0.5}$$

$$W.I=(L/100)*(L-(5.715*b))$$

where $L_s$, $a_s$, and $b_s$ are the reflectivity reading for the soiled swatches and L,a,b are the reflectivity readings for the washed swatches. Each polymer was evaluated in three separate washing experiments. The detergent composition and levels of the components in parts by weight ("pbw") are shown in Table I. This composition was used for the above described performance evaluation and the results of the detergent performance evaluation are listed in Table III. The reflectance of the soiled cloths was measured before laundering so that only cloths of the same reflectance were used in a test. Reflectance was then measured after laundering to evaluate the efficacy of the polysuccinimide in the detergent. The values reported in Table III are the average of the change in detergency and whiteness index of three cloths relative to the control cloths laundered in detergent not containing polymer.

Additional detergent formulations representative but not limited to possible formulations in which polysuccinimides may be used are shown in Table II.

TABLE I

| WASH CONDITIONS | |
|---|---|
| APPARATUS- | Terg-o-tometer washing machine |
| AGITATION- | 100 revolutions per minute |
| TEMPERATURE- | 40° C. |
| WATER HARDNESS- | 100 parts per million ("ppm") |
| WASH CYCLE- | 12 minutes |
| RINSE CYCLE- | 3 minutes |
| WATER LEVEL- | 1 liter |
| DETERGENT DOSAGE- | 1300 ppm |
| BALLAST- | 5 cloths per load (3 soiled/ 2 unsoiled) |

Detergent Composition Used to Evaluate Polysuccinimide for Soil Removal and Anti-Repeosition

| Detergent Component | pbw |
|---|---|
| sodium carbonate | 22.0 |
| zeolite A | 16.0 |
| sodium silicate | 2.7 |
| LAS | 8.3 |
| lauryl sulfate | 8.3 |
| sodium sulfate | 34.0 |
| polymer | as shown in Table III |

TABLE II

POWDER COMPOSITIONS

| | TPP[1] | PYRO[2] | Phos-phate | NON-Phos-phate |
|---|---|---|---|---|
| LAS[3] | 5 | 5 | 6 | 7.5 |
| Lauryl Sulfate | 8 | 13 | — | — |
| Alcohol Ether Sulfate | 3 | — | — | — |
| PEO[4]Alcohol | 1.5 | 2 | — | — |
| TPP | 38 | — | 30 | — |
| Pyro | — | 30 | — | — |
| Sodium Carbonate | 10 | 13 | 7 | 7.5 |
| Sodium Sulfate | 15 | 24 | 15 | 20 |
| Sodium Silicate | 6 | 5 | 5 | 1.5 |
| Zeolite A | — | — | — | 25 |
| Opt. Brightener | 0.2 | 0.2 | 0.2 | 0.2 |
| Enzyme | 0.5 | 0.5 | 0.3 | 0.3 |

TABLE II-continued

POWDER COMPOSITIONS

| | TPP[1] | PYRO[2] | Phos-phate | NON-Phos-phate |
|---|---|---|---|---|
| NaPAA[5] | — | 0.7 | — | — |
| Soap | — | — | 1 | — |
| Nonionic(EO/PO[6]) | — | — | 5 | 5 |
| Perborate | — | — | 20 | 2.5 |
| TAED[7] | — | — | 4 | — |
| Anti-Redep. Agents | — | — | 0.2 | 0.2 |
| Sulfate | — | — | 0.5 | 0.3 |
| Water | Q.S. | Q.S. | Q.S. | Q.S. |

1 Sodium Tripolyphosphate
2 Sodium Pyrophosphate
3 Linear Alkyl Sulfonates
4 Polyethoxylate
5 Sodium salt of polyacrylic acid
6 Ethylene Oxide/Propylene Oxide
7 Tetraacetyl Ethylene Diamine

TABLE III

| Polymer | pbw | Cotton Detergency | Cotton Whiteness |
|---|---|---|---|
| None | 0 | 0 | 0 |
| Polysuccinimide | 1.5 | 0.6 | 4.0 |
| Poly(aspartic acid) | 1.5 | 0.9 | 3.2 |
| Polysuccinimide | 3 | 1.9 | 7.1 |
| Poly(aspartic acid) | 3 | 2.5 | 5.8 |
| Polysuccinimide | 6 | 2.7 | 5.4 |
| Poly(aspartic acid) | 6 | 2.3 | 5.8 |
| Polysuccinimide | 12 | 2.4 | 4.9 |
| Poly(aspartic acid) | 12 | 1.8 | 3.9 |

The data appearing in Table III show the effects of polysuccinimide on clay soil removal (detergency) and anti-redeposition (whiteness). Polysuccinimide is uniformly better than the no-polymer control at all levels tested. Polysuccinimide also shows uniform benefits, on an equal-weight basis, for whiteness at all levels tested over poly(aspartic acid). At levels above 3 pbw of the detergent formulation, polysuccinimide shows a benefit, on an equal weight basis, for detergency over poly(aspartic acid)

Anti-Encrustation Performance Evaluation

The detergent formulations of the present invention were evaluated to quantitatively assess the effects on the deposition of inorganic scale on fabric. The effects of deposition were evaluated by comparing data from unwashed, ashed cloths to data from cloths washed multiple times and then ashed. Cotton/Terry blend cloths were washed five times in a typical U.S. detergent formulation under typical U.S. conditions (see Table IV). Cotton and Cotton/Terry blend cloths were washed ten times in a typical European detergent formulation under typical European conditions (see Table V).

Typical U.S. wash conditions were simulated by the Terg-o-tometer in the manner described above for the soil-removal tests. The wash conditions used appear on Table IV.

Typical European conditions were simulated by the following method:

Kenwood brand Mini-E washing machines were filled with six liters of tap water. Calcium chloride and magnesium chloride were added to the water to yield 350 ppm of hardness and in such amounts as to yield a ratio of calcium ions to magnesium ions of 3:1 calculated as calcium carbonate. The washing machines were loaded with approximately 500 grams of fabric including all-cotton terry fabric, cotton fabric, cotton/polyester blends, and polyester. The detergent was added to the machine and the machine was run for an entire cycle. The loads were run for 10 complete cycles, with addition of soil and detergent before each cycle. Other washing conditions which were used in these experiments are found in Table V, below.

The data that appearing in Table V, below, are the ash content of the all-cotton and cotton/terry cloths before washing and after ten cycles under European conditions, and after five cycles under U.S. conditions. Cloth samples were dried overnight at room temperature. The cloths were then weighed and placed in a Thermolyne brand muffle furnace (Model number 30400) for 6-7 hours at 800° C. under air. After cooling to room temperature, the ashes that remained were weighted. The values reported in Table V, below, are the percentages by weight of the original sample cloth which remained as ash after being treated in the furnace (averaged over three cloths per experiment).

TABLE IV

| TYPICAL U.S. WASH CONDITIONS | |
|---|---|
| APPARATUS- | Terg-o-tometer washing machine |
| AGITATION- | 100 revolutions per minute |
| TEMPERATURE- | 40° C. |
| WATER HARDNESS- | 100 ppm |
| WASH CYCLE- | 12 minutes |
| RINSE CYCLE- | 3 minutes |
| WATER LEVEL- | 1 liter |
| DETERGENT DOSAGE- | 1300 ppm |
| BALLAST- | 5 cloths per load (3 soiled/ 2 unsoiled) |

Typical U.S. Detergent Composition Used to Evaluate Polysuccinimide for Anti-Encrustation

| Detergent Component | pbw |
|---|---|
| sodium carbonate | 32.0 |
| zeolite A | 18.4 |
| sodium silicate | 3.2 |
| LAS | 6.4 |
| Tergitol 24-L-60 | 2.4 |
| sodium sulfate | 28.0 |
| sodium stearate | 2.4 |
| polymer | as shown in Table VI |

TABLE V

| TYPICAL EUROPEAN WASH CONDITIONS | |
|---|---|
| APPARATUS- | Kenwood Mini-E washing machine |
| TEMPERATURE- | 90° C. |
| WATER HARDNESS- | 350 ppm |
| AGITATION- | High |
| WASH CYCLE- | 30 minutes |
| WATER LEVEL- | 6 liters |
| DETERGENT DOSAGE- | 6.5 grams per liter of water |

Typical European Detergent Composition Used to Evaluate Polysuccinimide for Anti-Encrustation

| Detergent Component | pbw |
|---|---|
| sodium carbonate | 15.0 |
| zeolite A | 23.0 |
| sodium silicate | 4.0 |
| LAS | 8.3 |
| Tergitol 24-L-60 | 3.0 |
| sodium sulfate | 35.0 |
| sodium stearate | 3.0 |
| silicon defoamer | 1.0 |
| polymer | as shown in Table VI |

TABLE VI

ASH CONTENT

| Polymer | U.S. Conditions pbw | Cotton/Terry | Standard Deviation |
|---|---|---|---|
| None | 0 | 1.62 | 0.05 |
| Polysuccinimide | 3 | 1.06 | 0.01 |
| Poly(aspartic acid) | 3 | 1.09 | 0.03 |
| Polysuccinimide | 6 | 0.85 | 0.01 |
| Poly(aspartic acid) | 6 | 0.99 | 0.03 |

TABLE VI-continued

ASH CONTENT

| Polymer | European Conditions pbw | Cotton | Standard Deviation | Cotton/Terry | Standard Deviation |
|---|---|---|---|---|---|
| None | 0 | 2.77 | 0.05 | 2.63 | 0.08 |
| Polysuccinimide | 2 | 2.26 | 0.10 | 2.54 | 0.08 |
| Poly(aspartic acid) | 2 | 2.34 | 0.08 | 2.60 | 0.07 |
| Polysuccinimide | 4 | 2.59 | 0.10 | 2.22 | 0.03 |
| Poly(aspartic acid) | 4 | 2.64 | 0.04 | 2.82 | 0.07 |
| Polysuccinimide | 8 | 1.68 | 0.13 | 1.62 | 0.12 |
| Poly(aspartic acid) | 8 | 2.52 | 0.12 | 2.36 | 0.02 |
| Poly(aspartic acid) | 11.2 | 2.48 | 0.09 | 2.80 | 0.13 |
| None[1] | 0 | 2.08 | 0.16 | 1.98 | 0.05 |
| Polysuccinimide[2] | 20 | 0.67 | 0.03 | 0.70 | 0.07 |

[1]Detergent formulation was 3 pbw Tergitol 24-L-60, 1 pbw silicon defoamer, 8 pbw LAS, 4 pbw sodium silicate, 20 pbw perborate, 3 pbw sodium stearate, 23 pbw zeolite and 30 pbw sodium sulfate.

[2]Detergent formulation was 3 pbw Tergitol 24-L-60, 1 pbw silicon defoamer, 8 pbw LAS, 4 pbw sodium silicate, 20 pbw sodium perborate, 3 pbw sodium stearate, 23 pbw zeolite, 10 pbw sodium sulfate and 20 pbw polysuccinimide.

The data appearing in Table VI show the effects of polysuccinimide on anti-encrustation. Polysuccinimide is uniformly better than the no-polymer control at all levels tested under both U.S. and European conditions. Polysuccinimide also shows uniform benefits, on an equal-weight basis, at all levels tested over poly(aspartic acid) under both U.S. and European conditions. Polysuccinimide also shows a benefit on an equimolar basis for anti-encrusatation over poly(aspartic acid); polysuccinimide at 8 pbw is the molar equivalent of poly(aspartic acid) at 11.2 pbw.

We claim:

1. A detergent composition comprising:

a) from 0.5 to about 50 percent by weight polysuccinimide;

b) from 0 to about 50 percent by weight of one or more surfactants; and, in addition to the polysuccinimide, c) from 0.5 to about 85 percent by weight of one or more builders.

2. The detergent composition of claim 1, wherein: surfactant is present at a level of from about 5 to about 45 percent by weight.

3. The detergent composition of claim 2, wherein: polysuccinimide is present at a level of from about 1 to about 30 percent by weight.

4. The detergent composition of claim 1, wherein: polysuccinimide is present at a level of from about 1 to about 30 percent by weight.

5. The detergent composition of claim 1, wherein: the detergent composition is a laundry detergent composition.

6. The detergent composition of claim 1, wherein: the detergent composition is an automatic machine dishwashing detergent composition.

7. A method of formulating a detergent composition comprising: adding polysuccinimide to a level of from 0.5 to about 50 percent by weight of the detergent composition.

8. The method of claim 7, wherein: polysuccinimide is added to a level of from about 1 to about 30 percent by weight of the detergent composition.

9. The method of claim 7, wherein: the detergent composition is a laundry detergent composition.

10. The method of claim 7, wherein: the detergent composition is an automatic machine dishwashing detergent composition.

* * * * *